US011553281B2

(12) United States Patent
Grinnip, III et al.

(10) Patent No.: US 11,553,281 B2
(45) Date of Patent: Jan. 10, 2023

(54) ELECTROSTATIC HEADPHONE WITH INTEGRATED AMPLIFIER

(71) Applicant: Shure Acquisition Holdings, Inc., Niles, IL (US)

(72) Inventors: Roger Stephen Grinnip, III, Lake Zurich, IL (US); Arjun Krishnakumar, Chicago, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 41 days.

(21) Appl. No.: 17/303,460

(22) Filed: May 28, 2021

(65) Prior Publication Data

US 2021/0377672 A1 Dec. 2, 2021

Related U.S. Application Data

(60) Provisional application No. 63/032,357, filed on May 29, 2020.

(51) Int. Cl.
*H04R 1/10* (2006.01)
*H04R 19/02* (2006.01)

(52) U.S. Cl.
CPC ..... *H04R 19/02* (2013.01); *H04R 1/1008* (2013.01); *H04R 1/1066* (2013.01); *H04R 2201/028* (2013.01); *H04R 2420/07* (2013.01)

(58) Field of Classification Search
CPC ..... H04R 1/1091; H04R 5/04; H04R 5/033; H04R 19/02; H04R 2420/01; H04R 2420/03; H04R 2420/09; H04R 2430/00; H04R 10/00; H04R 10/005
See application file for complete search history.

(56) References Cited

U.S. PATENT DOCUMENTS

| | | | | |
|---|---|---|---|---|
| 9,210,497 | B2 | 12/2015 | Grinnip, III | |
| 10,178,465 | B2 * | 1/2019 | Grell | H04R 5/04 |
| 2011/0227631 | A1 | 9/2011 | Yamkovoy | |
| 2014/0064510 | A1 | 3/2014 | Grinnip, III | |
| 2016/0057525 | A1 | 2/2016 | Kappus | |
| 2018/0367884 | A1 | 12/2018 | Murarka | |

FOREIGN PATENT DOCUMENTS

| | | |
|---|---|---|
| CN | 210016601 | 2/2020 |
| DE | 4329991 | 3/1995 |
| JP | 2006041569 | 2/2006 |

OTHER PUBLICATIONS

International Search Report and Written Opinion for PCT/US2021/070640 dated Sep. 13, 2021, 12 pp.

* cited by examiner

*Primary Examiner* — Amir H Etesam
(74) *Attorney, Agent, or Firm* — Neal, Gerber & Eisenberg LLP

(57) ABSTRACT

An electrostatic headphone is provided, comprising a first ear cup assembly, a second ear cup assembly, and a headband assembly coupled to each of the first ear cup assembly and the second ear cup assembly. Each ear cup assembly comprises an electrostatic transducer, a high voltage amplifier electrically coupled to the transducer, and a high voltage power supply electrically coupled to the high voltage amplifier. At least one of the ear cup assemblies further comprises a power source for providing electric power to the high voltage power supply included in the at least one ear cup assembly. In some cases, one or more of the ear cup assemblies further comprises a wireless communication module for receiving audio signals from an audio source.

21 Claims, 7 Drawing Sheets

ELECTROSTATIC HEADPHONE WITH INTEGRATED AMPLIFIER

CROSS-REFERENCE

This application claims priority to U.S. Provisional Patent Application No. 63/032,357, filed on May 29, 2020, the contents of which are incorporated herein by reference in their entirety

TECHNICAL FIELD

This application generally relates to an electrostatic headphone. In particular, this application relates to a headphone comprising an electrostatic transducer and a high voltage amplifier and power supply in each ear cup assembly.

BACKGROUND

Audio listening devices, such as, e.g., loudspeakers, headphones, and earphones, can utilize an electrostatic transducer for sound reproduction that includes a tensioned conductive low-mass diaphragm positioned between a pair of conductive stator plates. Small air gaps may be present between the diaphragm and the stator plates, and the diaphragm may have a stationary charge relative to the stator plates. If no signal is applied to the stator plates, the diaphragm may be static and stay centered between the stator plates. When equal magnitude opposite-phase audio signals are applied to the stator plates, a net force imbalance may be created over the diaphragm, which displaces the diaphragm. In turn, the air adjacent to the diaphragm may be displaced to create sound corresponding to the audio signals.

As a result, audio listening devices that use electrostatic transducers may have very low harmonic distortion, full bandwidth frequency response, and high fidelity sound reproduction, as compared to loudspeakers, headphones, and earphones with moving coil transducers, for example. Electrostatic transducers may have these characteristics due to the push-pull, constant charge electrostatic drive and the relatively low mass of the diaphragm. In particular, the low harmonic distortion may be due to the push-pull electrostatic drive and the nearly constant bias charge on the diaphragm. However, to generate sufficient and acceptable sound output with an electrostatic transducer, high voltages may be required for biasing the diaphragm and for producing the audio signals.

Headphones typically comprise a pair of ear cups coupled to each other by a resilient curved band, e.g., a headband, that is configured to apply sufficient force to the ear cups to hold the headphone in place on the user's head. Each ear cup includes at least one acoustic transducer, or audio driver, for producing sounds, and is designed to be positioned close to the auditory canal of the user's ear to create an acoustically necessary coupling space there between. In some existing headphones, one or more of the ear cups may also include a power source (e.g., battery) and wireless communication circuitry for receiving audio signals from an external device (e.g., a personal listening device or smartphone), thus allowing for wireless, or cable-free, headphone operation. However, such existing headphones typically include moving coil transducers that are not capable of providing the high fidelity sound reproduction and full bandwidth frequency response characteristics of an electrostatic transducer.

Some existing headphones include an electrostatic transducer and high voltage amplifier in each ear cup, but such headphones are not configured for wireless, or cable-free, operation. For example, DE 4329991 describes an electrostatic headphone that is connected to an external device using a cable for transporting unamplified audio signals and low voltage power signals from the external device to one or more of the ear cups. As another example, U.S. Pat. No. 10,178,465 describes an electrostatic headphone that is coupled to a pre-amplifier using a cable for transporting a voltage-amplified audio signal and a high-voltage power supply from the pre-amplifier to the headphone. Many users prefer the ease and simplicity of a cable-free headphone, especially for virtual or alternate reality experiences and gaming, but also for personal listening experiences and in professional use, such as mixing or mastering music.

Accordingly, there is an opportunity for a headphone system that addresses these concerns. More particularly, there is an opportunity for an electrostatic headphone that is capable of providing high fidelity sound reproduction even during wireless, or cable-free, operation.

SUMMARY

The invention is intended to solve the above-noted problems by providing an electrostatic headphone having, among other things, a pair of ear cup assemblies, each ear cup assembly comprising, in addition to an electrostatic transducer, (1) an integrated high voltage amplifier configured to amplify incoming audio signals prior to providing the signals to a corresponding electrostatic transducer, and (2) an integrated high voltage power supply configured to provide high voltage power to the high voltage amplifier, and at least one of the ear cup assemblies further comprising (3) wireless communication circuitry configured to wireless receive the incoming audio signals.

An exemplary embodiment provides an electrostatic headphone comprising a first ear cup assembly, a second ear cup assembly, and a headband assembly coupled to each of the first ear cup assembly and the second ear cup assembly. Each ear cup assembly comprises an electrostatic transducer, a high voltage amplifier electrically coupled to the transducer, and a high voltage power supply electrically coupled to the high voltage amplifier. One or more of the ear cup assemblies further comprises a wireless communication module for receiving audio signals from an audio source, and at least one of the ear cup assemblies further comprises a power source for providing electric power to the high voltage power supply included in the at least one ear cup assembly. According to some aspects, one or more of the ear cup assemblies further comprises a wireless communication module for receiving audio signals from an audio source.

Another exemplary embodiment provides an electrostatic headphone comprising a first ear cup assembly; a second ear cup assembly; and a headband assembly coupled to each of the first ear cup assembly and the second ear cup assembly, wherein each ear cup assembly comprises an electrostatic transducer, a high voltage amplifier electrically coupled to the electrostatic transducer, and a high voltage power supply electrically coupled to the high voltage amplifier, and wherein the first ear cup assembly further comprises a power source configured to provide electric power to the high voltage power supply included in the first ear cup assembly, and the second ear cup assembly further comprises a wireless communication module configured to wirelessly receive audio signals from an external audio source.

These and other embodiments, and various permutations and aspects, will become apparent and be more fully understood from the following detailed description and accompanying drawings, which set forth illustrative embodiments that are indicative of the various ways in which the principles of the invention may be employed.

DETAILED DESCRIPTION

Figure 1:
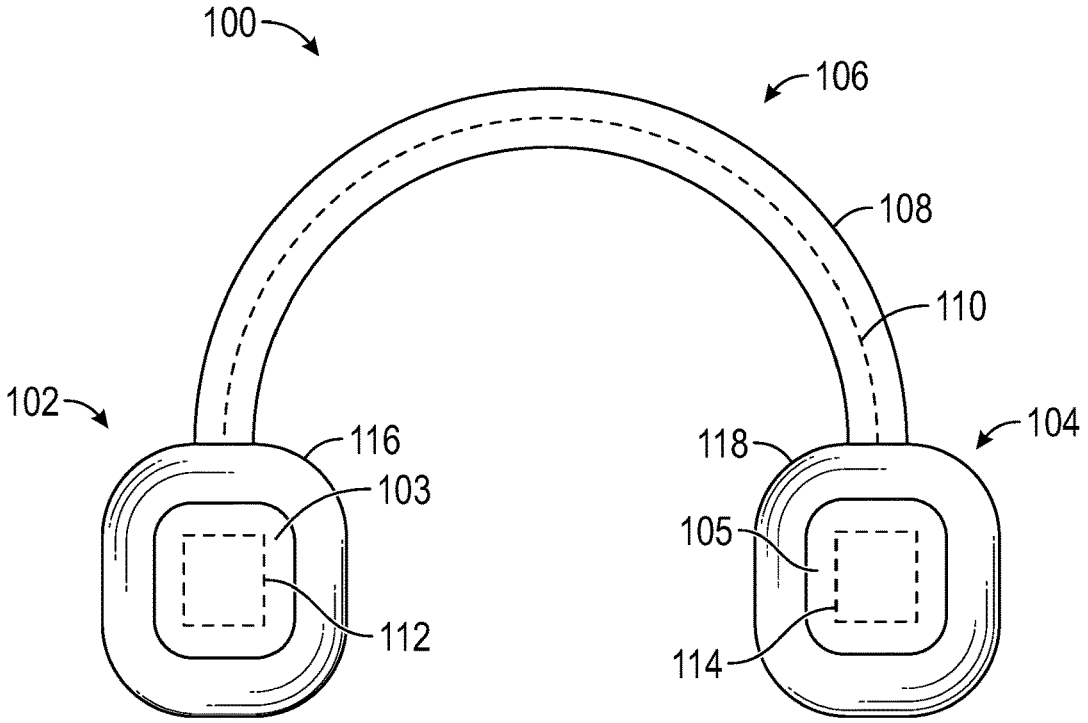
FIG. 1 is a schematic diagram depicting an exemplary electrostatic headphone, in accordance with certain embodiments.

The description that follows describes, illustrates and exemplifies one or more particular embodiments of the invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. As stated above, the specification is intended to be taken as a whole and interpreted in accordance with the principles of the invention as taught herein and understood to one of ordinary skill in the art.

With respect to the exemplary systems, components and architecture described and illustrated herein, it should also be understood that the embodiments may be embodied by, or employed in, numerous configurations and components, including one or more systems, hardware, software, or firmware configurations or components, or any combination thereof, as understood by one of ordinary skill in the art. Accordingly, while the drawings illustrate exemplary systems including components for one or more of the embodiments contemplated herein, it should be understood that with respect to each embodiment, one or more components may not be present or necessary in the system.

FIG. 1 illustrates an exemplary electrostatic headphone 100, in accordance with embodiments. The headphone 100 comprises a left ear cup 102 (also referred to herein as a "first ear cup assembly") housing a first electrostatic transducer for generating sound in accordance with an input audio signal, a right ear cup 104 (also referred to herein as a "second ear cup assembly") comprising a second electrostatic transducer for generating sound in accordance with an input audio signal, and a headband 106 (also referred to herein as a "headband assembly") coupled to each of the ear cups 102 and 104. In some embodiments, the ear cups 102 and 104 may be configured to output a single channel of audio, for example, by routing the same audio channel to each side. In other embodiments, the ear cups 102 and 104 may be configured to output dual channel audio, for example, by routing a different audio channel to each side.

Each ear cup 102, 104 may include a sound-permeable front face 103, 105 made of fabric, film, wire mesh, or other suitable material, and, in some cases, a partially or fully enclosed rear face (not shown) made of metal, plastic, or other suitable material. A depth of each ear cup 102, 104 may be selected to accommodate the electrostatic transducer disposed therein and/or an acoustical cavity required thereby.

The headband 106 comprises a resilient, U-shaped band or harness 108 configured to have an adjustable curvature, so as to be arranged around a portion of the head or neck of the user (or wearer). As shown, each end of the band 108 is coupled to a respective one of the ear cups 102, 104. In some embodiments, a cable 110 is embedded within the band 108 for electrically coupling the left ear cup 102 to the right ear cup 104. For example, a first end of the cable 110 may be coupled to circuitry 112 embedded within the left ear cup 102 and a second end of the cable 110 may be coupled to circuitry 114 embedded within the right ear cup 104. According to various embodiments, the cable 110 may be configured to transport power, audio signals, data signals, or any combination thereof, between the ear cups 102 and 104. For example, the cable 110 may include a separate wire or cable for transporting each type of signal.

Figure 3:
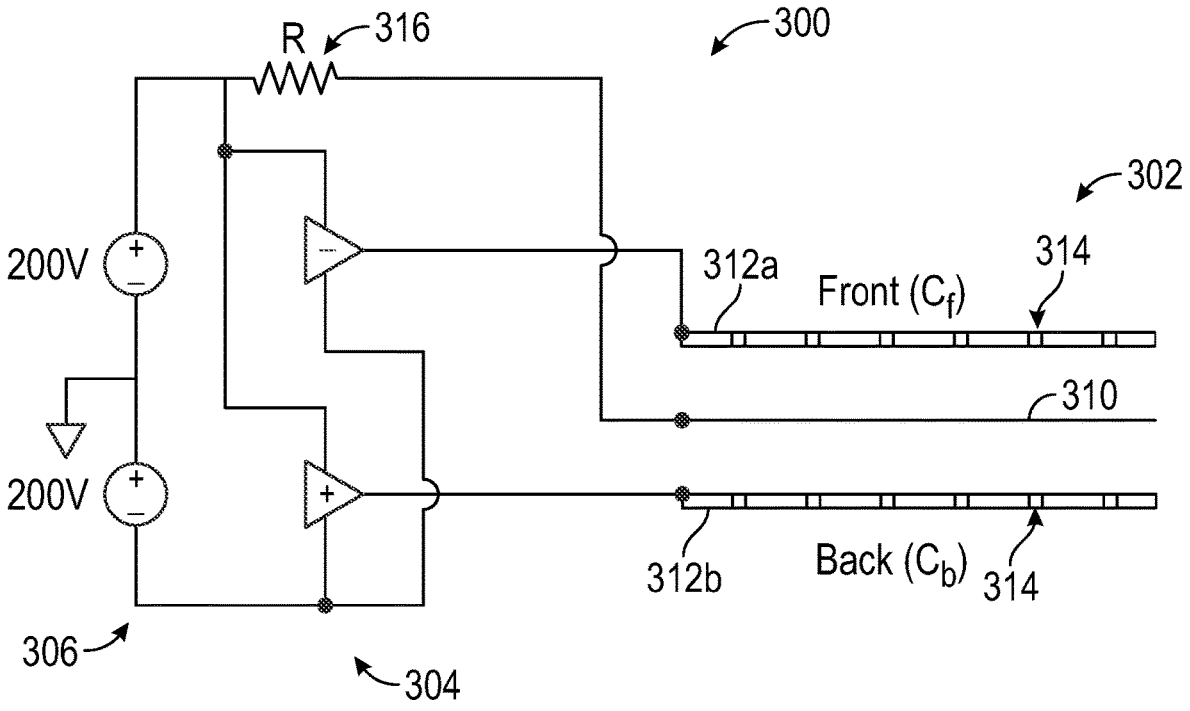
FIG. 3 is a circuit diagram illustrating an exemplary electrostatic transducer coupled to a high voltage amplifier and power supply, in accordance with certain embodiments.

The circuitry 112, 114 included in each ear cup 102, 104 comprises the corresponding transducer, as well as a high voltage power supply and a high voltage amplifier, and one or more other electronic components for controlling operation of the headphone 100 (for example, as shown in FIG. 3). Such electronic components may include, for example, a power source for providing electric power, a wireless communication module for wirelessly receiving audio and/or data signals, one or more microphones, one or more sensors, and/or various other types of hardware, such as, e.g., discrete logic circuits, application specific integrated circuits (ASIC), programmable gate arrays (PGA), field programmable gate arrays (FPGA), digital signal processors (DSP), microprocessor, etc.

As also shown in FIG. 1, the headphone 100 further comprises ear pads 116 and 118 wrapped circumferentially around a sound-radiating (or front) side of respective ear cups 102 and 104 to provide comfortable positioning of the ear cups 102 and 104 on the user's ears. In some embodiments, the ear pads 116 and 118 may be configured for circumaural (or "over-ear") usage, so that the ear cups 102 and 104 enclose the ears completely. In other embodiments, the ear pads 116 and 118 may be configured for supra-aural (or "on-ear") usage, such that the ear cups 102 and 104 rest on the ears without completely enclosing or enveloping them.

Figure 2:
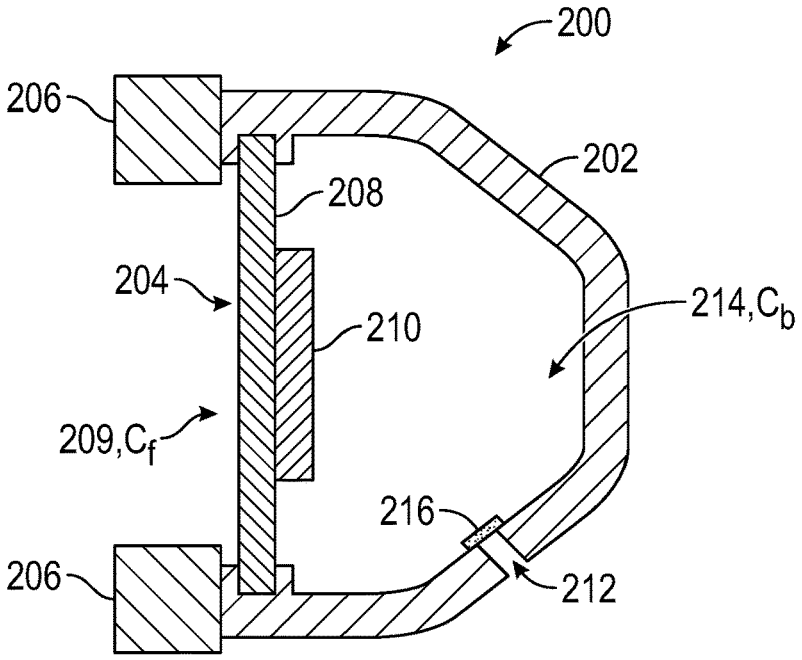
FIG. 2 is an enlarged, cross-sectional schematic diagram illustrating an exemplary ear cup assembly of the electrostatic headphone shown in FIG. 1, in accordance with certain embodiments.

Referring additionally to FIG. 2, shown is an enlarged, cross-sectional view of an exemplary ear cup assembly 200 of the electrostatic headphone 100, in accordance with embodiments. The ear cup assembly 200 may represent, or correspond to, any one of the ear cups 102 and 104 shown in FIG. 1. For example, in some embodiments, the ear cup assembly 200 may be a cross-sectional view of the right ear cup 104 with the left ear cup 102 being a mirror image thereof.

As shown in FIG. 2, the ear cup assembly 200 includes a housing 202, a circuitry component 204 disposed within the housing 202, and an ear pad 206 circumferentially surrounding a front side of the housing 202. The housing 202 may be configured to protect and structurally support the circuitry component 204, which includes an electrostatic transducer 208 (also referred to herein as an "electrostatic audio driver") for converting an electrical audio signal into a corresponding sound. The circuitry component 204 may be substantially similar to the circuitry 112, 114 included in each ear cup 102, 104 shown in FIG. 1. Likewise, the ear pad 206 may be substantially similar to the ear pad 116, 118 included in each ear cup 102, 104 shown in FIG. 1. In some embodiments, the ear pad 206 may be configured to form a front volume 209 at a sound-radiating, or front, side of the electrostatic transducer 208.

The circuitry component 204 further comprises an electronics module 210 for controlling operation of the electrostatic transducer 208 and/or other aspects of the headphone 100. In some embodiments, the electronics module 210 may be implemented using one or more printed circuit boards (PCBs) and may be attached or coupled to an external surface of the electrostatic transducer 208, as shown in FIG. 2. In other embodiments, the electronics module 210 may be integrated into the electrostatic transducer 208, for example, by placing the components of the electronics module 210 directly on one of the stator plates included in the electrostatic transducer 208. In still other embodiments, the electronics module 210 may be implemented on an independent PCB that is physically separated from the transducer 208 but electrically coupled to the same using one or more wires. For example, the electronics module 210 may be disposed in a different location of the ear cup housing 202 than that of the transducer 208, or in a headband connecting the ear cup 200 to another ear cup (such as, e.g., headband 106). More details on the components of the electronics module 210 are provided below with respect to FIG. 5. Likewise, more details on the electrostatic transducer 208 are provided below with respect to FIGS. 3 and 4.

Figure 7:
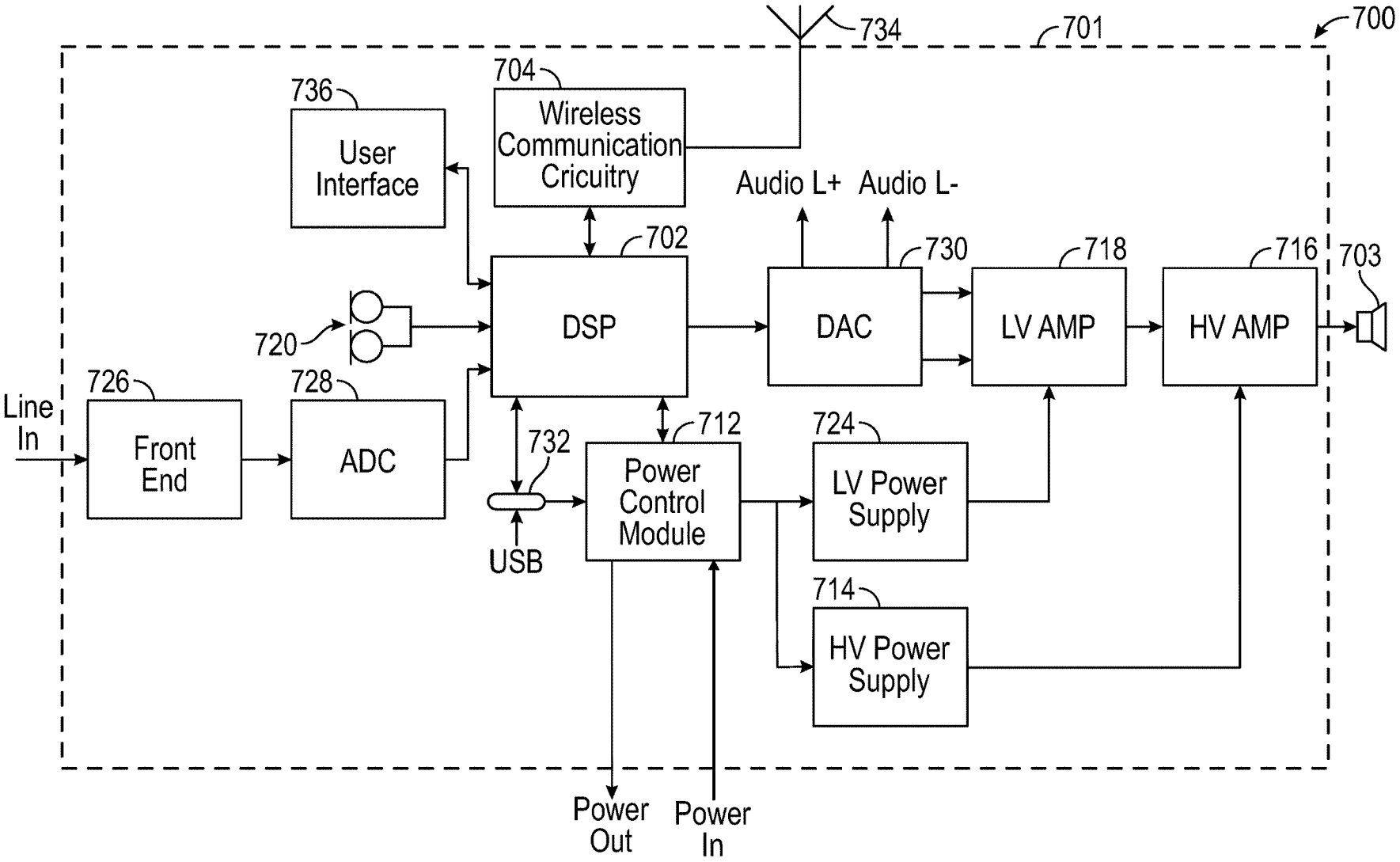
FIG. 7 is a block diagram depicting exemplary components of a second ear cup assembly included in the same electrostatic headphone as the ear cup assembly of FIG. 6, in accordance with certain embodiments.
Figure 9:
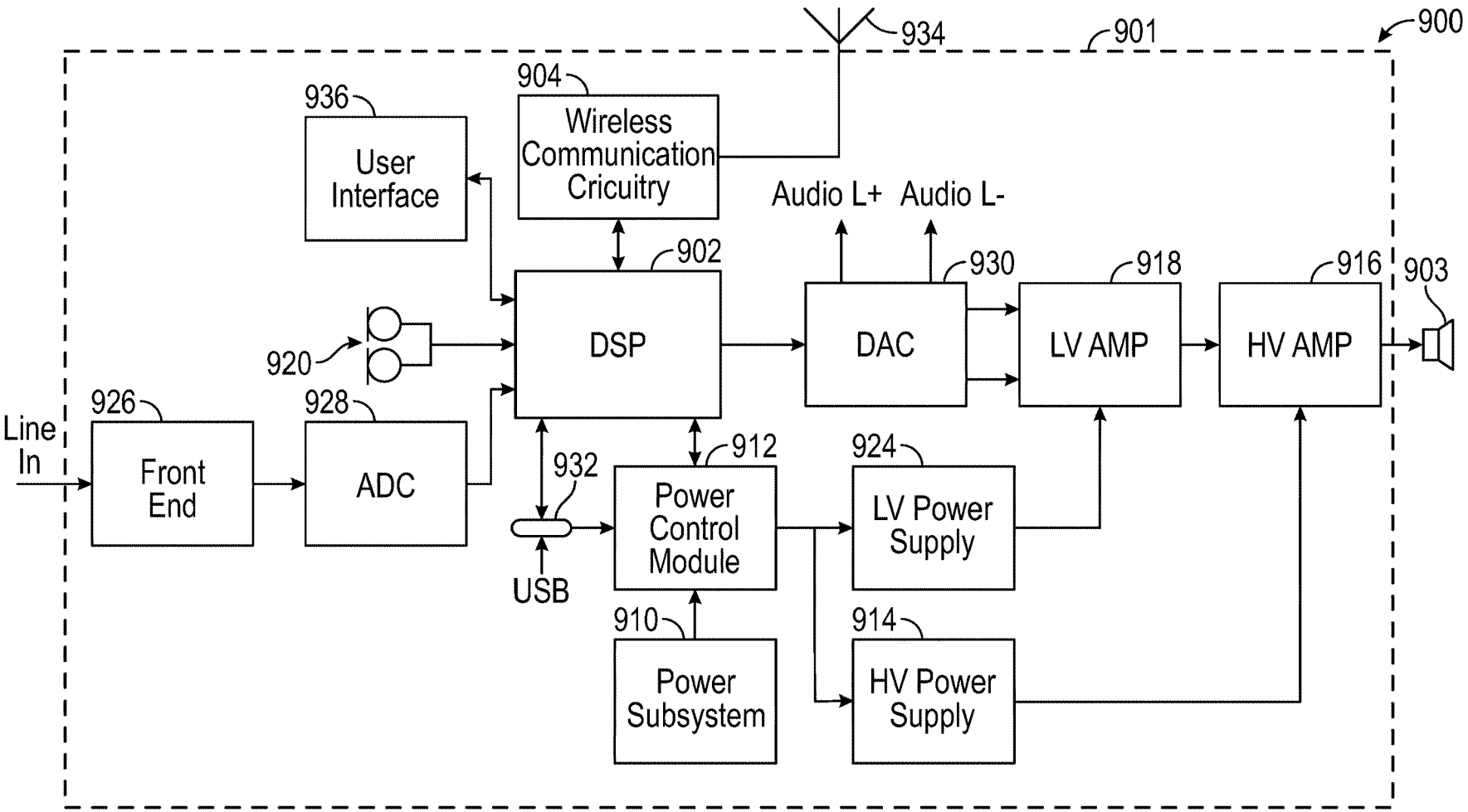
FIG. 9 is a block diagram depicting exemplary components of a second ear cup assembly included in the same electrostatic headphone as the first ear cup assembly of FIG. 8, in accordance with certain embodiments.

The sound output by the electrostatic transducer 208 may represent any type of input audio signal including, for example, live or real-time audio spoken by human speakers, pre-recorded audio files reproduced by an audio player, streaming audio received from a remote audio source using a network connection, etc. According to embodiments, the input audio signals may be digital or analog signals. In the latter case, the electronics module 210 may include one or more components, such as, e.g., analog to digital converters, processors, and/or other components, to process the analog audio signals and generate corresponding digital audio signals (e.g., as shown in FIGS. 7 and 9). The input audio signals may be transported to the electronics module 210 from an external audio source, such as, e.g., a media player, smartphone, mobile phone, tablet, computer, etc.

Figure 8:
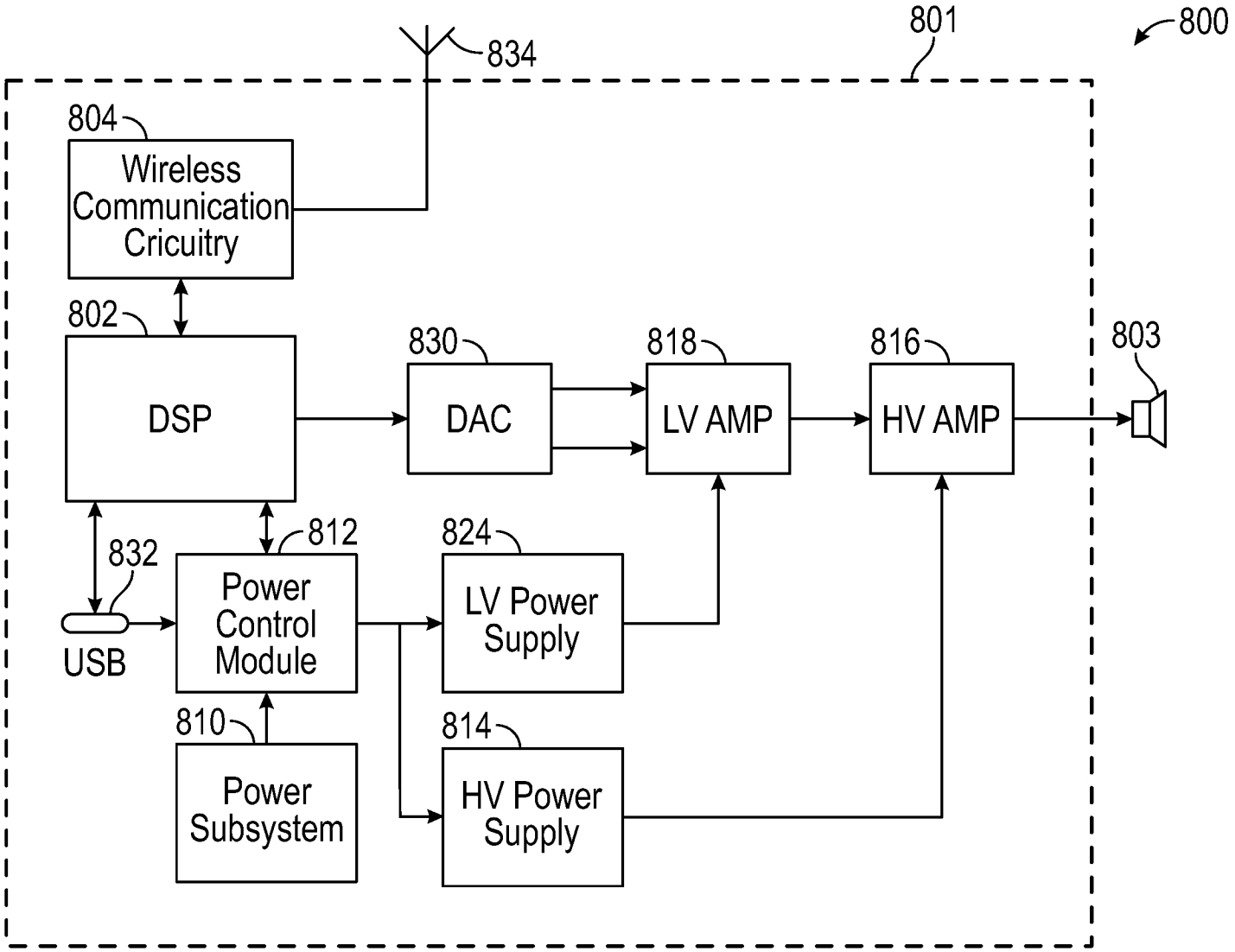
FIG. 8 is a block diagram depicting exemplary components of a first ear cup assembly included in another exemplary electrostatic headphone, in accordance with certain embodiments.

In some embodiments, the ear cup assembly 200 may further include one or more external ports (e.g., as shown in FIGS. 7 through 9) for receiving power, control signals, and/or audio signals from one or more external audio sources or other devices, via a cable coupled to the port and said device. In some embodiments, the external ports may also be used to transmit control signals and/or audio signals to the one or more external devices. The external ports may be electrically coupled to the electronics module 210 for providing the received signals to the electronics module 210 (or a processor included therein) and/or for receiving outgoing signals therefrom. As an example, the external ports may include a Universal Serial Bus (USB) port (e.g., USB, USB-C, mini-USB, etc.), a 3.5 mm audio port, or any other port capable of coupling to a cable for transporting power, control, and/or audio to and from the electrostatic headphone 100.

The control or data signals transported to the electronics module 210 may include control information received from a user interface of the headphone 100 (e.g., as shown in FIGS. 7 and 9) and/or information received from by one or more external devices coupled to the headphone 100. As an example, the control information may include user control information, such as, e.g., mute on or off inputs, volume or gain inputs, power on or off inputs, equalizer selections, acoustic noise cancellation (ANC) selections (e.g., FF, FB, or environment mode), etc., and/or adjustments to parameters of the electrostatic transducer or one or more components of the electronics module 210, such as, e.g., directionality, steering, software updates, etc.

In embodiments, the ear cup housing 202 may be configured to be closed-back, open-back, or semi-open back, depending on the type of sound desired from the electrostatic headphone 100. As the name suggests, closed-back headphones have ear cup housings with backs that are completely closed to the ambient environment, or acoustically sealed, thus blocking ambient noise from entering the headphones and reducing the amount of sound that can escape from the headphones into the environment. In contrast, open-back headphones have ear cup housings with backs that are open to the ambient environment, which allows ambient sound to enter the headphones and also allows sound from the headphones to escape into the environment. The sound produced by open-back headphones is generally considered more natural with an increased depth of field, as compared to closed-back headphones. However, closed-back headphones are typically used for studio monitoring and recording applications because they provide better sound isolation for critical listening, and because sound from open-back headphones may be picked up by recording microphones.

Semi-open back headphones have ear cup housings that are substantially closed-back except for an acoustic port for allowing a small leak to ambient, i.e. to a lesser extent than fully open-back headphones. For example, the ear cup housing 202 shown in FIG. 2 comprises an acoustic port 212

(e.g., aperture) configured to allow the passage of air into and out of an acoustic chamber 214 (also referred to herein as a "rear volume") formed around and/or behind the electrostatic transducer 208 by the ear cup housing 202. The ear cup housing 202 further comprises a resistance element 216 disposed over the acoustic port 212 on the inside of the acoustic chamber 214 (or over an interior end of the acoustic port 212). The resistance element 216 may be a porous material, such as, for example, a cloth fabric or wire mesh, and may be attached to the inside of the ear cup housing 202 using an adhesive or the like. The acoustic port 212 and the resistance element 216 may be configured to provide a controlled acoustical impedance between the internal acoustic network formed within the housing 202 and the ambient environment outside the housing 202. For example, the acoustical impedance may be set to tune a low frequency response (e.g., less than 1 kilohertz (kHz)) of the headphone 100.

Referring now to FIG. 3, shown is a circuit 300 comprising an exemplary electrostatic transducer 302, a high voltage amplifier 304 electrically coupled to the transducer 302 for supplying audio signals thereto, and a high voltage power supply 306 electrically coupled to the amplifier 304 for supplying high voltage power (e.g., 200 volts (V)) thereto, in accordance with embodiments. The electrostatic transducer 302 may be substantially similar to, or representative of, the electrostatic transducer 208 shown in FIG. 2, and the high voltage amplifier 304 and high voltage power supply 306 may be included in the electronics module 210 coupled thereto.

As shown in FIG. 3, the electrostatic transducer 302 comprises a diaphragm 310 positioned between a pair of stator plates 312*a* and 312*b*. The transducer 302 is configured to generate sound when equal magnitude opposite-phase AC audio signals are applied to the stator plates 312*a* and 312*b* by the high voltage amplifier 304, which causes the diaphragm 310 to deflect and displace air. The displacement of air by the diaphragm 310 generates sound according to the audio signals provided by the amplifier 304. As shown, the stator plates 312*a* and 312*b* may include a plurality of holes 314 for allowing the sound generated by the diaphragm 310 to travel out of the transducer 302 and towards the ear canal of the user (or wearer).

The AC audio signals may be received from an external audio source (not shown), such as, e.g., a media player, mobile phone, smartphone, stereo system, computer, tablet, compact disc player, or other device, and may be provided to the high voltage amplifier 304 either directly or indirectly (e.g., via other circuitry components of the headphone). The audio signals supplied by the high voltage amplifier 304 to the electrostatic transducer 302 may include a negative polarity signal and a positive polarity signal, which are respectively applied to the stator plates 312*a* and 312*b*. The audio signals must be of sufficiently high voltage in order to generate sufficient field strength in the electrostatic transducer 302. In embodiments, the high voltage power supply 306 may be a high frequency switching power supply configured to supply enough voltage to the high voltage amplifier 304 such that the AC audio signals supplied by the amplifier 304 to the stator plates 312*a* and 312*b* have sufficient voltage. As an example, the audio signals may be up to +/−200 V peak, and the frequency of the high frequency switching power supply may be 200 kilohertz (kHz).

In embodiments, the diaphragm 310 may be biased, either by a DC bias voltage supplied by the high voltage power supply 306 or through other electrical connection. For example, in some cases, the diaphragm 310 may be electrically connected by placing a resistor 316 with a large resistance value in series between the high voltage power supply 306 and the diaphragm 310. In other cases, the diaphragm 310 may be electrically connected through a resistive divider between the differential AC audio signals, such that the diaphragm 310 is biased halfway between the differential AC audio signals. In some embodiments, the circuit 300 may also include one or more resistors to limit any short circuit current of the DC bias voltage.

As shown, each stator plate 312*a*, 312*b* has an outer-facing side and an opposite, inner-facing side facing the diaphragm 310. For example, in FIG. 3, the outer-facing side of the first stator plate 312*a* is shown as facing a front volume, $C_f$, formed in front of the electrostatic transducer 302, and the outer-facing side of the second stator plate 312*b* is shown as facing a rear volume, $C_b$, formed behind the electrostatic transducer 302. It should be appreciated that in other embodiments, the orientation of the transducer 302 may be switched, so that the first stator plate 312*a* faces the rear volume $C_b$ and the second stator plate 312*b* faces the front volume $C_f$. As will be appreciated, the term "front" is used herein to refer to a sound-radiating side of the transducer 302, or the side closest to the wearer's ear, and the term "back" is used herein to refer to an opposite side of the transducer 302, or the side furthest from the wearer's ear.

In some embodiments, each of the stator plates 312*a* and 312*b* may be a printed circuit board (PCB) having various layers and traces, and appropriate vias between the layers, for achieving certain electrical connections, such as, e.g., connection to the high voltage amplifier 304. In some cases, one or more of the stator plates 312*a* and 312*b* may also include one or more circuitry components embedded into the outer-facing side of the plate, such as, e.g., the electronics module 210 shown in FIG. 2.

In the case of closed-back headphones, the motion of the diaphragm 310 may be dominated by the stiffness of an internal cavity created around the electrostatic transducer 302 by the ear cup housing (e.g., ear cup housing 202 shown in FIG. 2), or more specifically the rear volume $C_b$ (e.g., rear volume 214 shown in FIG. 2) and the front volume $C_f$ (e.g., front volume 209 shown in FIG. 2), due to the closed-back nature of the ear cup housing. Because the internal cavity of closed-back headphones is small, as compared to open-back headphones, the displacement of the diaphragm 310 is relatively small as well. By contrast, the diaphragm displacement in open-back headphones is primarily controlled by the stiffness of the diaphragm at low frequencies, due to the low mass and high fundamental resonance frequency of the diaphragm.

Figure 4:
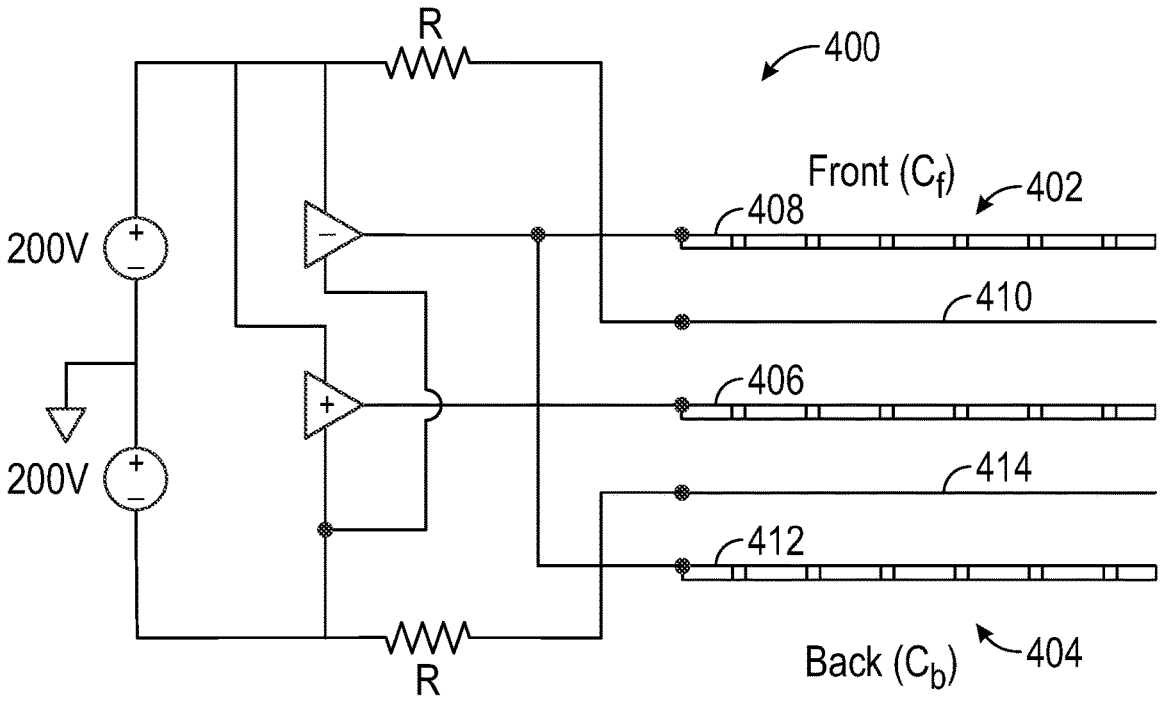
FIG. 4 is a circuit diagram illustrating another exemplary electrostatic transducer coupled to a high-voltage amplifier and high voltage power supply, in accordance with certain embodiments.

FIG. 4 illustrates an alternative circuit 400 configured to replicate the performance of an open-back electrostatic headphone baseline response in a closed-back type headphone, in accordance with embodiments. The circuit 400 comprises two identical electrostatic transducers or driver 402 and 404 that are acoustically connected in series in order to increase an acoustical output impendence of the overall circuit by a factor of two and thereby, most closely approximate a volume velocity source. In the illustrated case, the volume velocity is continuous through both drivers 402 and 404, but the electrical connection to each stack up is parallel.

More specifically, as shown in FIG. 4, the two electrostatic transducers 402 and 404 may be positioned adjacent to each other and layered or stacked one on top of the other), such that a common stator plate 406 is formed between the transducers 402 and 404. In addition, the first electrostatic transducer 402 may further comprise a first stator plate 408 and a first diaphragm 410 disposed between the first stator plate 408 and the common stator plate 406. Likewise, the second electrostatic transducer 404 may further comprise a second stator plate 412 and a second diaphragm 414 disposed between the second stator plate 412 and the common stator plate 406. Moreover, the second diaphragm 414 has a negative bias voltage (e.g., −200 VDC), while the first diaphragm 410 has a positive bias voltage (e.g., +200 VDC). Otherwise, the general operation of the circuit 400 may be substantially similar to that of the circuit 300 shown in FIG. 4. In embodiments, the electrostatic transducer 208 shown in FIG. 2 may be implemented using either the transducer design 302 shown in FIG. 3 or the transducer design 402 shown in FIG. 4.

Figure 5:
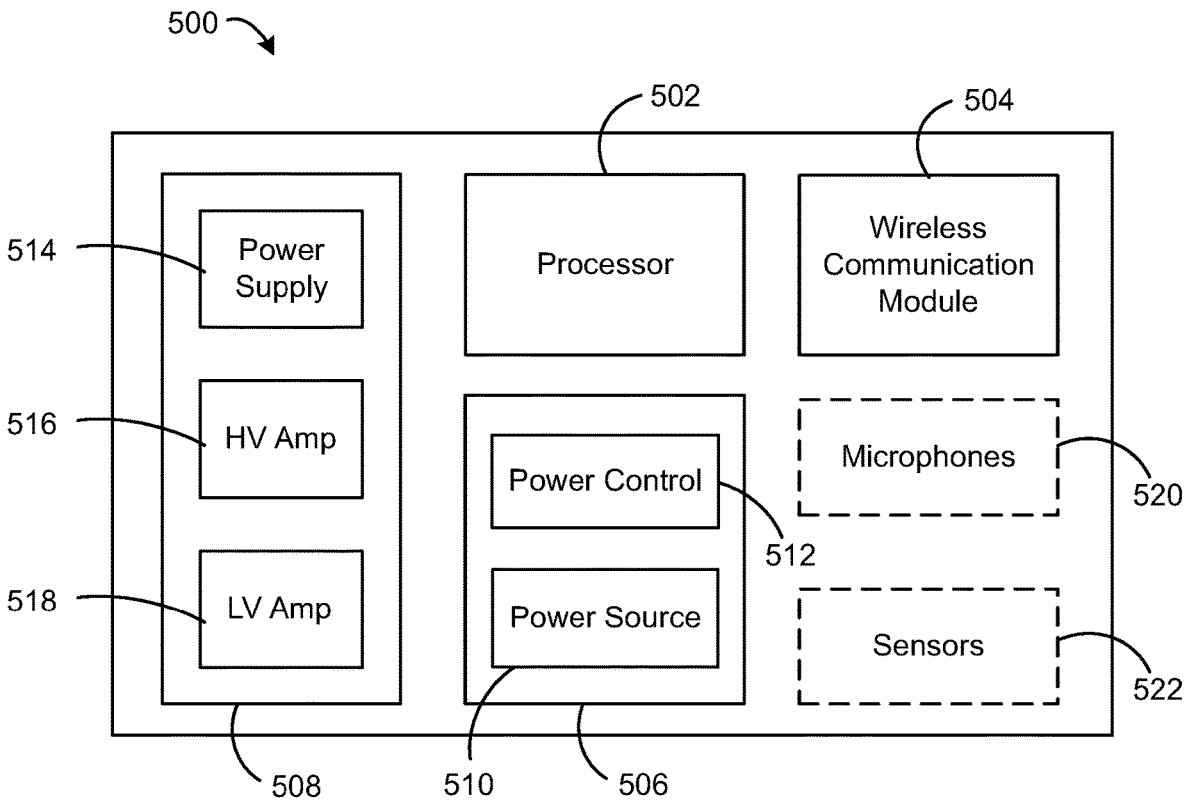
FIG. 5 is a block diagram depicting an exemplary electronics module of the ear cup assembly shown in FIG. 2, in accordance with certain embodiments.

Referring additionally to FIG. 5, shown is an exemplary electronics module 500 of the ear cup assembly 200, in accordance with embodiments. The electronics module 500 may represent, or correspond to, the electronics module 210 shown in FIG. 2 and may be included in either one, or both, of the ear cups 102 and 104 shown in FIG. 1. In some embodiments, the electronics module included in the circuitry 114 of the right ear cup 104 is the same as, or substantially similar to, the electronics module 500 shown in FIG. 5, whereas the electronics module included in the circuitry 112 of the left ear cup 102 comprises a smaller subset of the components shown in FIG. 5, as explained in more detail with respect to FIGS. 6 through 9.

As shown, the electronics module 500 comprises a processor 502, a wireless communication module 504, a power unit 506, and an amplification unit 508. The electronics module 500 may be configured to receive audio signals from an external audio source (not shown), such as, e.g., a media player, mobile phone, smartphone, stereo system, computer, tablet, compact disc player, or other device. The external audio source may be connected to the electronics module 500 via a stereo plug, a USB connection, a wireless connection, or other appropriate connection, as described herein (e.g., as shown in FIGS. 6 through 9). In some embodiments, the electronics module 500 may include an integrated circuit (e.g., a system on chip (SOC) or the like) that has several of the module's components embedded into the same circuit, such as, for example, the processor 502, the wireless communication module 504, power control module 512, and one or more of an analog to digital converter and a digital to analog converter.

The processor 502 may be configured to process the audio signals received from the external audio source. For example, the processor 502 may be configured to apply one or more audio correction techniques, such as, e.g., equalization, acoustic noise cancellation (ANC), etc., and/or one or more audio manipulation techniques, such as, e.g., three-dimensional (3D) cues for sound spatialization, voice activity detection, etc., to the audio signals. The processor 502 may be an audio processor, a digital signal processor (DSP), and/or other suitable hardware (e.g., microprocessor, dedicated integrated circuit, field programmable gate array (FPGA), Application Specific Integrated Circuit (ASIC), etc.).

The wireless communication module 504 can be configured to enable wireless communications with the external audio source, with a wireless communication module included in the other ear cup assembly, or other electronic component. The communication module 504 can include one or more antennas, radios, modems, receivers, and/or transmitters (not shown) for connecting to, or interfacing with, one or more wireless networks, such as, for example, WiFi, cellular, Bluetooth, Near Field Communication (NFC), Radio Frequency Identification (RFID), satellite, and/or infrared. In some embodiments, the wireless communication module 504 includes at least a Bluetooth transceiver (not shown) for receiving an audio stream from the external audio source, for receiving control signals from an external control device (e.g., a smart phone, mobile phone, computer, laptop, music player, stereo system. etc.), or a combination thereof. In some embodiments, the wireless communication module 504 is configured to transmit audio signals and/or data signals to the other ear cup of the electrostatic headphone, receive audio signals and/or data signals from the other ear cup, or a combination thereof.

In some embodiments, for example, as shown in FIG. 5, the power unit 506 comprises a power source 510 configured to provide an electrical power source for the electronics module 500 and a power control module 512 configured to manage power delivery from the power source 510 to the components of the electronics module 500, including routing the input electrical power to the amplification unit 508. In other embodiments, the power source 510 may be fully embedded within the ear cup housing 200, but located outside the electronics module 500. In such cases, the power source 510 may be electrically coupled to the power control module 512 of the power unit 506, for example, using an internal cable, electrical contact, or other appropriate connection.

The power source 510 may include one or more batteries (e.g., a lithium ion battery, one or more alkaline batteries, etc.), circuitry for receiving electrical power from a Universal Serial Bus (USB) port coupled to an external power source via a USB cable, or other appropriate power source (e.g., a phantom power supply). In some cases, the power source 510 may be a rechargeable battery that is charged using a cable coupled to an external port of the ear cup housing (e.g., a charging port, a USB port, etc.) or using wireless charging technology (e.g., inductive charging, Qi, etc.). In other cases, the power source 510 may be a battery that is replaced once the battery power or charge is depleted.

The power control module 512 may comprise circuitry for managing power sharing, or delivery of electrical power from the power source 510 to the power supply 514. In some embodiments, the power control module 512 further comprises one or more of a fuel gauge configured to monitor power consumption and usage of the power source 510, a battery management system, battery protection circuitry, and power charging circuitry for managing electrical power received via a charging port (e.g., a USB port). In other embodiments, the power source 510 may include one or more of the fuel gauge, the battery management system, and the battery protection circuitry, either instead or additional The amplification unit 508 comprises a high voltage power supply 514 that may be substantially similar to the high voltage power supply 306 shown in FIG. 3, a high voltage amplifier 516 that may be substantially similar to the high voltage amplifier 304 shown in FIG. 3, and a low voltage amplifier 518 (also referred to as a "preamplifier"). The low voltage amplifier 518 may be configured to receive the audio signals from the processor 502 and amplify the audio signals by a first predetermined amount of gain (e.g., 10 dB), or gain factor (e.g., 1, 2, etc.). The low voltage amplifier 518 may then provide the amplified signals to the high voltage amplifier 516 for further amplification, by a second predetermined amount of gain (e.g., 33 decibels (dB)), or gain factor (e.g., 20, 40, etc.), before providing the audio signals to the stator plates of the electrostatic transducer. In some embodiments, the amplification unit 508 is configured as a multi (or dual) stage amplifier, with the low voltage amplifier 518 serving as the first stage amplifier and the high voltage amplifier serving as the second stage amplifier. In embodiments, the amplifiers 516 and 518 may be class D amplifiers or switching amplifiers, another type of electric amplifier, or any other suitable amplifier.

The high voltage power supply 514 may be configured to supply enough voltage to the high voltage amplifier 516 such that the audio signals applied to the stator plates of the electrostatic transducer have sufficient voltage (e.g., 200 V). In some embodiments, a separate low voltage power supply (not shown) is used to supply power to the low voltage amplifier 518 (e.g., as shown in FIGS. 6 through 9). Both the high voltage power supply 514 and low voltage power supply may receive electric power from the power unit 506. In particular, the power control module 512 may be configured to manage delivery of electric power from the power source 510 to the high voltage power supply 514.

In some embodiments, the electronics module 500 also includes one or more microphones 520 for detecting sound in a given environment and converting the sound into an audio signal that may be used for taking voice calls and/or for the purpose of implementing acoustic echo cancellation (AEC) or noise cancellation, voice lift, ambient mixing, and other audio processing techniques designed to improve the performance of the electrostatic headphone. The microphone(s) 520 may include any suitable type of microphone element, such as, e.g., a micro-electrical mechanical system (MEMS) transducer, condenser microphone, dynamic transducer, piezoelectric microphone, etc. In some preferred embodiments, the microphone(s) 520 include at least two digital (MEMS) microphones.

In some embodiments, the electronics module 500 comprises one or more sensors or sensing devices 522 for assisting with various functions of the electrostatic headphone. For example, the one or more sensors 522 may be configured to detect a head position of the user wearing the electrostatic headphones and/or a position of the ear cup assemblies relative to each other for implementing spatial hearing or three-dimensional stereophonic sound techniques. As another example, the one or more sensors 522 may be configured to detect whether the headphone is being worn by the user (e.g., on the user's ears) and/or detect the presence of voice or other signal activity for implementing an automatic shut off feature, an automatic mute feature, or the like. In embodiments, the sensor(s) 522 may include one or more of a microphone or other electric device for detecting voice or other signal activity; and a position sensor, proximity sensor, accelerometer, gyroscope, magnetometer, inertial measurement unit (IMU), or other electronic device for measuring or detecting a linear position (relative or absolute), orientation, acceleration, rotation, angle, movement, or other physical characteristic of the ear cup housing.

In some embodiments, if the audio signal received from the external audio source is analog, the electronics module 500 may further include an analog-to-digital converter for converting the analog audio signal into a digital audio signal before it reaches the processor 502 for digital signal processing (e.g., as shown in FIGS. 7 and 9). In such cases, the electronics module 500 may also include a digital-to-analog converter for converting each digital audio signal back into an analog audio signal prior to amplification by the amplifiers 516 and 518 (e.g., as shown in FIGS. 7 and 9).

Figure 6:
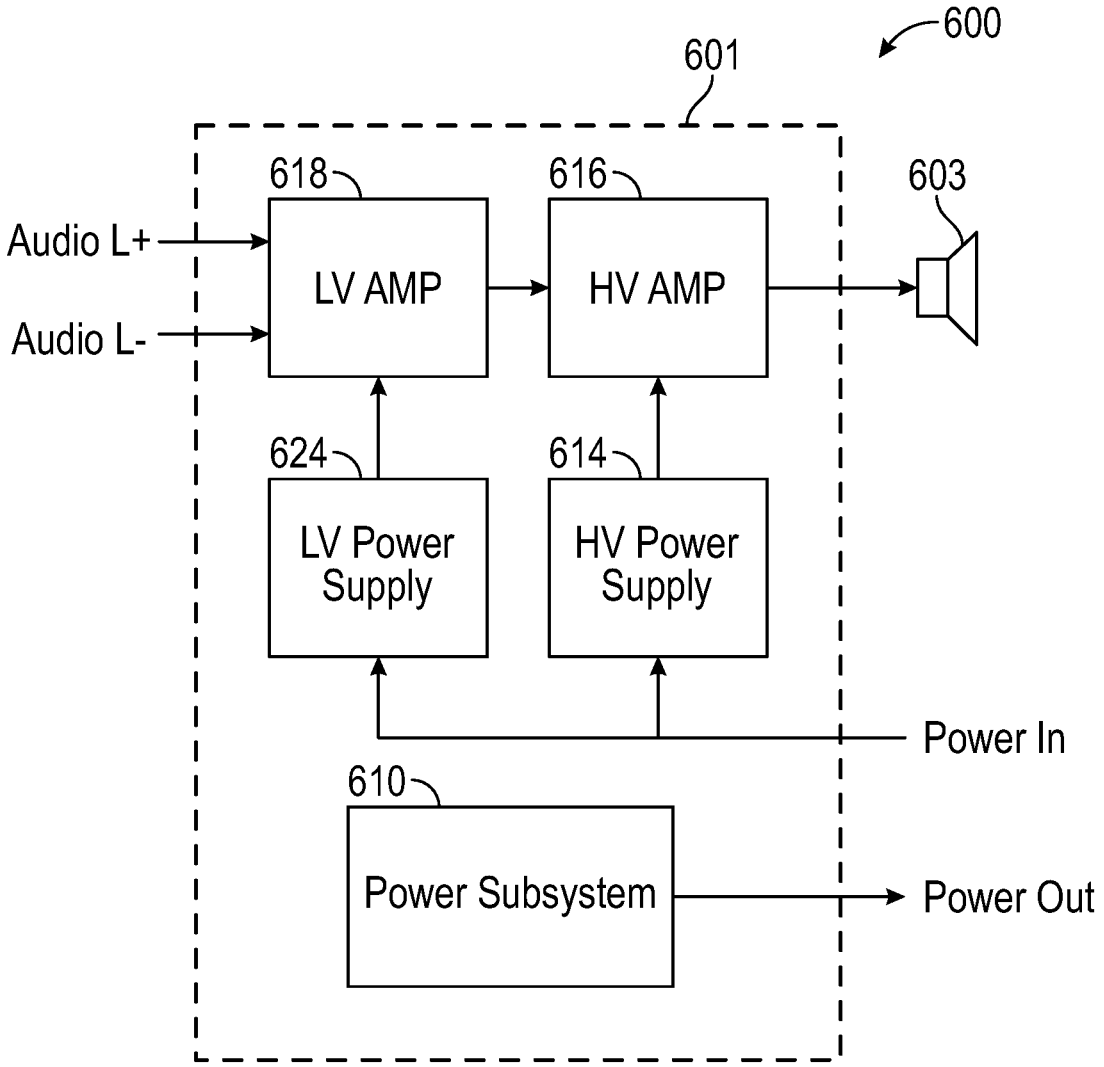
FIG. 6 is a block diagram depicting exemplary components of a first ear cup assembly included in an exemplary electrostatic headphone, in accordance with certain embodiments.

FIGS. 6 and 7 depict exemplary circuitry 600 and 700 that may be included in first and second ear cups, respectively, of an electrostatic headphone with integrated amplifier and power source, in accordance with certain embodiments. FIGS. 8 and 9 depict exemplary circuitry 800 and 900 that may be included in first and second ear cups, respectively, of an electrostatic headphone with integrated amplifier and power source, in accordance with certain other embodiments. In each case, the electrostatic headphone may be substantially similar to the electrostatic headphone 100 shown in FIG. 1, each ear cup may be substantially similar to the ear cup assembly 200 shown in FIG. 2, and an electrostatic transducer included in each ear cup may be substantially similar to either the electrostatic transducer 302 shown in FIG. 3 or the electrostatic transducer 402 shown in FIG. 4. Moreover, the depicted sets of circuitry (i.e. 600 and 700 or 800 and 900) may be included in respective ear cups 102 and 104 as circuitry 112 and 114, may be electrically coupled to each other using a cable embedded within a headband coupled between the two ear cups (e.g., headband 106 shown in FIG. 1), and may be configured and/or positioned within each ear cup like circuitry component 204 of ear cup assembly 200, for example. Further, each circuitry 600, 700, 800, and 900 includes an electronics module with components that may be substantially similar to corresponding components of the electronics module 500 shown in FIG. 5. Accordingly, the following descriptions of FIGS. 6 through 9 will refer to FIGS. 1-5, and the corresponding components will not be described again in detail, for the sake of brevity. In some embodiments, the electronics module may include an integrated circuit (e.g., a system on chip (SOC) or the like) that has several of the module's components embedded into the same circuit, such as, for example, a processor, wireless communication circuitry, power management module, analog to digital converter, digital to analog converter, etc.

Referring now to FIGS. 6 and 7, a first circuitry 600 included in a first ear cup of the electrostatic headphone comprises a first electronics module 601 electrically coupled to a first electrostatic transducer 603, and a second circuitry 700 included in a second ear cup of the electrostatic headphone comprises a second electronics module 701 electrically coupled to a second electrostatic transducer 703. In embodiments, the first electronics module 601 may be in communication with the second electronics module 701 in order to transport one or more of power, audio signals, and data signals between the two ear cups, for example, over a cable electrically coupled to each circuitry 600 and 700 and embedded within a headband of the electrostatic headphone (e.g., the cable 110 shown in FIG. 1). In the illustrated embodiment, the first circuitry 600 is included in a left ear cup of the electrostatic headphone, and the second circuitry 700 is included in a right ear cup of the same headphone. In other embodiments, the reverse may be true, i.e. the first circuitry 600 may be included in the right ear cup of the electrostatic headphone, and the second circuitry 700 may be included in the left ear cup of the same headphone.

As shown, the first electronics module 601 comprises a power subsystem 610 (e.g., similar to power source 510) and a first amplification unit (e.g., similar to amplification unit 508). The first amplification unit comprises a low voltage amplifier 618 (e.g., similar to low voltage amplifier 518) electrically coupled to a low voltage power supply 624, and a high voltage amplifier 616 (e.g., similar to high voltage amplifier 516) electrically coupled to a high voltage power supply 614 (e.g., similar to high voltage power supply 514). The power subsystem 610 comprises a power source, which may include a low voltage battery (e.g., 5 V), a phantom power supply, circuitry for receiving power from a USB port, or other appropriate power source. In some embodiments, the power subsystem 610 may also include protection circuitry for regulating the battery (e.g., a battery management system, a protection circuit module (PCM), overcurrent charge or discharge current protection, over or under voltage protection, temperature protection, etc.) and/or a fuel gauge for monitoring power consumption and usage. As shown, the power subsystem 610 is configured to send or provide electric power to the second electronics module 701 included in the other ear cup. In some cases, the power subsystem 610 also transmits data (or control) signals related to regulating the power source to the second electronics module 701, or more specifically, a power control module 712 included therein, and/or receives control signals therefrom.

As shown in FIG. 6, each of the low voltage power supply 624 and the high voltage power supply 614 receives electrical power from the second electronics module 701 included in the other ear cup. In turn, the low voltage power supply 624 may be configured to supply appropriate low voltage power (e.g., 6 V or USB) to the low voltage amplifier 618. Likewise, the high voltage power supply 614 may be configured to supply appropriate high voltage power (e.g., +/−200 V, 500 μA) to the high voltage amplifier 616. In some embodiments, each of the high voltage power supply 614 and the low voltage power supply 624 may be implemented using a switching power supply. In other embodiments, the power supplies 614 and/or 624 may be implemented using other types of power supplies or electric power converters.

As shown in FIG. 6, the low voltage amplifier 618 may receive audio signals from the second electronics module 701 of the other ear cup. In embodiments, the first and second electronics module 601 and 701 may be configured to output a single channel of audio, wherein the same audio signal is routed to each side of the headphone. The audio signals may include two AC audio signals of equal magnitude and opposite phase, i.e. a positive polarity signal and a negative polarity signal, as shown. The low voltage amplifier 618 may be configured to amplify the audio signals according to a first gain amount (e.g., 10 dB) and send the amplified signals to the high voltage amplifier 616. The high voltage amplifier 616 may be configured to further amplify the amplified (or pre-amplified) audio signals according to a second gain amount (e.g., 33 dB) and send the amplified signals to the electrostatic transducer 603. The amplified signals may be applied to respective stators included in the first electrostatic transducer 603 in order to generate sound according to the received audio signals.

Referring now to FIG. 7, the second electronics module 701 comprises a second amplification unit comprising a low voltage amplifier 718 electrically coupled to a low voltage power supply 724, and a high voltage amplifier 716 electrically coupled to a high voltage power supply 714. The amplifiers 718, 716 and power supplies 724, 714 may operate like the corresponding amplifiers 618, 616 and power supplies 624, 614 shown in FIG. 6. The power supplies 724 and 714 are also electrically coupled to the power control module 712 for receiving electric power therefrom.

As shown, the power control module 712 may be configured to receive electric power from the power subsystem 610 located in the other ear cup and deliver electric power to each of the low voltage power supply 724 and the high voltage power supply 714, as well as each of the low voltage power supply 624 and the high voltage power supply 614 located in the other ear cup. In some cases, the power control module 712 also transmits data (or control) signals to the power subsystem 610, and/or receives control signals therefrom. The power control module 712 may also be electrically coupled to the processor 702, as shown. In some embodiments, the power control module 712 may include an integrated circuit or other circuitry configured to manage power delivery to each of the power supplies 624, 614, 724, and 714, as well as monitor power consumption and usage of the power source in the power subsystem 610, e.g., using a fuel gauge included in the power control module 712. In some cases, the power control module 712 may manage power consumption and usage of the power subsystem 610 based on the data signals received therefrom, and provide alerts to the processor 702 related to battery life and health, etc.

In some embodiments the power control module 712 receives electric power from an external power source via a USB port 732 (also referred to as a "charging port") of the second electronics module 701. For example, the USB port 732 may be electrically coupled to the external power source using an external cable coupled to the external power source on one end and to the USB port 732 on the other end. In some cases, the power control module 712 may provide the received power to the power subsystem 610, for example, in order to charge the battery or other power source included therein, as shown. In other embodiments, the power received via the USB port 732 may be provided directly to one or more other components of the second electronics module 701 and/or to the power control module 712 for delivery to the power supplies 724 and 714.

The processor 702 may be a digital signal processor or other audio processor (e.g., similar to the processor 502) and may be configured to receive audio signals from one or more external audio sources or devices and provide the audio signals to the low voltage amplifier 718 for output via the electrostatic transducer 703. In some cases, the processor 702 is also configured to process the received audio signals, for example, in order to apply audio correction techniques (e.g., equalization, etc.).

The electronics module 701 may further comprise wireless communication circuitry 704 (e.g., similar to wireless communication module 504) configured to receive audio signals from an external audio source (e.g., smartphone, mobile phone, tablet, computer, speaker system, media player, etc.) using an antenna 734 for connecting to a wireless communication network (e.g., WiFi, Bluetooth, etc.). As shown, the wireless communication circuitry 704 is electrically coupled to the processor 702 and may provide the received audio signals to the processor 702. In some cases, the wireless communication circuitry 704 may also be configured to transmit data signals and/or audio signals received from the processor 702 to the external audio source or other external device.

In some embodiments, the processor 702 may also receive audio signals from one or more audio ports included in, or electrically coupled to, the second electronics module 701. Said audio signals may be analog, digital, or a combination thereof, and may be configured to receive a cable that is electrically coupled to an external audio source. One such audio port may be the USB port 732, which may be configured to receive high resolution digital audio signals from the external audio source. Another audio port may be an analog audio port (e.g., 3.5 mm audio port, etc.) coupled to a front end module 726, or interface, for receiving analog signals from the external audio source. The second electronics module 701 may further comprise an analog to digital converter 728 coupled to (or between) the front end module 726 and the processor 702 for converting the received analog audio signals to digital audio signals.

The second electronics module 701 also comprises a digital to analog converter 730 coupled to (or between) the processor 702 and the low voltage amplifier 718 for converting the audio signals processed by the processor 702 into analog audio signals prior to outputting the audio signals to the amplifiers (or amplification units) in both ear cups. More specifically, as shown in FIGS. 6 and 7, the digital to analog converter 730 may be configured to provide equal magnitude, opposite phase analog audio signals to both the low voltage amplifier 718 of the second electronics module 701 and the low voltage amplifier 618 of the first electronics module 601. In some embodiments, the processor 702 may be configured to add an appropriate amount of delay to the audio signals provided to the low voltage amplifier 718 in order to ensure simultaneous output of the audio signals by the first and second electrostatic transducers 603 and 703.

In some embodiments, the second electronics module 701 may also comprise one or more microphones 720 (e.g., similar to the microphones 520) for enabling call functionality and/or for implementing acoustic noise cancellation, ambient mixing, etc. The microphones 720 may be configured to capture or detect sound, either produced by the user (e.g., during a phone call) or existing in the environment around the user (e.g., noise), and convert the detected sound to audio signals. The microphones 720 may provide the audio signals to the processor 702, which, in the case of a phone call, may output the audio signals via the antenna 734 or one of the audio ports (e.g., USB port 732) to an external device.

In some embodiments, the second electronics module 701 further comprises a user interface 736 electrically coupled to the processor 702 and disposed on an external surface of the electrostatic headphones. The user interface 736 may be configured to receive user inputs for controlling operation of the electrostatic headphone, such as, e.g., mute on or off selections, power on or off selections, volume level selections, and the like. In some cases, the user interface 736 may also be configured to display or provide information to the user. The user interface 736 may be implemented in hardware, software, or a combination thereof. As an example, the user interface 736 may comprise one or more user input devices (such as, e.g., a touch screen, button(s), slider(s), knob(s), etc.), display devices, light indicators (e.g., light emitting diode (LED), vibrating indicators (e.g., haptic transducer), or any combination thereof.

Thus, FIGS. 6 and 7 depict an embodiment of a wireless or cable-free electrostatic headphone in which the power subsystem 610 (or power source) is embedded in one ear cup, the wireless communication circuitry 704 is embedded in another ear cup, and each ear cup includes a separate amplification unit (i.e. amplifiers 616, 618, 716, 718 and associated power supplies 614, 624, 714, 724) for providing appropriate AC audio signals to the electrostatic transducer coupled to that amplification unit.

Referring now to FIGS. 8 and 9, shown is another embodiment of a wireless, or cable-free, electrostatic headphone wherein each of the ear cups comprises, in addition to an amplification unit, an individual power source and its own wireless communication circuitry for receiving wireless audio and/or data signals. Other than these differences, the individual components of circuitry 800 and 900 may be substantially similar to corresponding components of the circuitry 600 and 700 and therefore, will not be described again in detail for the sake of brevity.

More specifically, FIG. 8 illustrates a first circuitry 800 included in a first ear cup of said electrostatic headphone and comprising a first electronics module 801 electrically coupled to a first electrostatic transducer 803. FIG. 9 illustrates a second circuitry 900 included in a second ear cup of said headphone and comprising a second electronics module 901 electrically coupled to a second electrostatic transducer 803. In the illustrated embodiment, the first circuitry 800 is included in a left ear cup of the electrostatic headphone, and the second circuitry 900 is included in a right ear cup of the same headphone. In other embodiments, the reverse may be true, i.e. the first circuitry 800 may be included in the right ear cup of the electrostatic headphone, and the second circuitry 900 may be included in the left ear cup of the same headphone.

In some embodiments, the first electronics module 801 of FIG. 8 may be in communication with the second electronics module 901 of FIG. 9 in order to transport one or more of power, audio signals, and data signals between the two ear cups. In some cases, audio and/or data signals may be transported wirelessly between the electronics modules 801 and 901 using respective wireless communication circuitry 804 and 904 (e.g., similar to wireless communication circuitry 704 of FIG. 7) and corresponding antennas 834 and 934 (e.g., similar to antenna 734 of FIG. 7). In other cases, audio, data, and/or power may be transported between the two modules 801 and 901 using a cable electrically coupled to each circuitry 800 and 900 and embedded within a headband of the electrostatic headphone (e.g., cable 110 of FIG. 1).

As shown, the first electronics module 801 comprises a first processor 802 (e.g., similar to processor 702) for processing the audio signals received from the one or more external audio sources. The first electronics module 801 further comprises a first power control module 812 (e.g., similar to power control module 712) electrically coupled to the processor 802, and a first power subsystem 810 (e.g., similar to power subsystem 610) electrically coupled to the power control module 812. In addition, the module 801 further comprises a first amplification unit comprising a low voltage amplifier 818 (e.g., similar to low voltage amplifier 618) electrically coupled to a low voltage power supply 824 (e.g., similar to low voltage power supply 624), and a high voltage amplifier 816 (e.g., similar to high voltage amplifier 616) electrically coupled to a high voltage power supply 814 (e.g., similar to high voltage power supply 614). The first power subsystem 810 may include a power source (e.g., battery) configured to supply or provide electric power to the first power control module 812. In turn, the first power control module 812 may be configured to provide or deliver electric power to each of the power supplies 824 and 814. In some embodiments, the first power control module 812 may be configured to monitor a power consumption and usage of the power source of the power subsystem 810 (e.g., using a fuel gauge included in the power control module 812), in addition to managing power delivery to the power supplies 824 and 814, and in some cases, may transmit data signals to the power subsystem 810, and/or receive data signals therefrom, related to said monitoring.

The first electronics module 801 further comprises a first USB port 832 (e.g., similar to USB port 732) that is electrically coupled to the first power control module 812, as well as to the first processor 802. In some embodiments, the first USB port 832 (also referred to herein as a "charging port") may be used to transport power to the first electronics module 801 from an external power source, for example, in order to charge a rechargeable battery included in the first power subsystem 810, or to provide an alternative power source for the power supplies 824 and 814. In such cases, the first USB port 832 may provide the received power to the first power control module 812 for distribution to the power supplies 824 and 814. In some embodiments, the first USB port 832 is additionally, or alternatively, configured to receive audio signals from an external audio source and provide the received audio signals to the first processor 802.

As previously mentioned, the first electronics module 801 also comprises first wireless communication circuitry 804 electrically coupled to a first antenna 834. The first wireless communication circuitry 804 uses the first antenna 834 to connect to a wireless network (e.g., WiFi, Bluetooth, etc.) and receive audio signals, or data signals, from an external audio source, or device, coupled to the same network. The first wireless communication circuitry 804 may also use the antenna 834 to wirelessly receive audio and/or data signals from the second electronics module 901. In some embodiments, the audio signal may be dual channel, and a different audio channel may be routed to each ear cup, or each of the electronics modules 801 and 901. In other embodiments, the audio signal may contain a single channel of audio that is routed to each side (or ear cup).

The first processor 802 may be configured to process the audio signals received via the first wireless communication circuitry 804, or the first USB port 832, in accordance with one or more audio correction algorithms (e.g., equalization, etc.). In embodiments, the received audio signals may be digital, and the first electronics module 801 may further comprise a first digital to analog converter 830 (e.g., similar to digital to analog converter 730) coupled to the first processor 802 for converting the digital audio signals to analog audio signals. The first digital to analog converter 830 may then provide the analog audio signals to the low voltage amplifier 818 for amplification and output via the first electrostatic transducer 803.

Referring now to FIG. 9, the second electronics module 901 comprises a second processor 902 (e.g., similar to the first processor 802) for processing the audio signals received from the one or more external audio sources, a second power control module 912 (e.g., similar to the first power control module 812) electrically coupled to the second processor 902, and a second power subsystem 910 (e.g., similar to the first power subsystem 810) electrically coupled to the second power control module 912. In addition, the second module 901 further comprises a second amplification unit comprising a low voltage amplifier 918 (e.g., similar to low voltage amplifier 818) electrically coupled to a low voltage power supply 924 (e.g., similar to low voltage power supply 824), and a high voltage amplifier 916 (e.g., similar to high voltage amplifier 816) electrically coupled to a high voltage power supply 914 (e.g., similar to high voltage power supply 814). The power subsystem 910 may include a power source (e.g., battery or phantom power supply) and may be configured to provide or supply electric power from the power source to the power control module 912. The power control module 912, in turn, may be configured to provide or deliver the electric power to each of the low voltage power supply 924 and the high voltage power supply 914, as shown. In some embodiments, the power control module 912 may also be configured to monitor a power consumption and usage of the power source in the power subsystem 910, in addition to managing delivery of power to the power supplies 924 and 914, and, in some cases, transmit data signals to the power subsystem 910, and/or receive data signals therefrom, related to said monitoring.

As shown, the second electronics module 901 further comprises a second USB port 932 (e.g., similar to the first USB port 832) for receiving audio signals and/or data signals from an external audio source or device, and/or providing power to the second power control module 912, for example, in order to charge a battery of the second power subsystem 910 or as an alternative power source for the power supplies 924 and 914.

In some embodiments, the second electronics module 901 may further comprise one or more components that are not included in the first electronics module 801. For example, in FIG. 9, the second electronics module 901 also comprises one or more analog audio ports, such as, e.g., a 3.5 mm audio port or the like, coupled to a front end module 926 (e.g., similar to front end module 726) for receiving the analog audio signals. The front end module 926 may provide the received signals to an analog to digital converter 928 (e.g., similar to analog to digital converter 728) in order to digitize the signals before providing them to the second processor 902. In some embodiments, the second electronics module 901 also comprises one or more digital microphones 920 (e.g., similar to microphones 720) and/or a user interface 936 (e.g., similar to the user interface 736) for receiving additional inputs.

Once the received audio signals are processed, the second processor 902 provides the processed signals to a second digital to analog converter 930 (e.g., similar to digital to analog converter 830), which is coupled to the second amplification unit, or more specifically, the low voltage amplifier 918. The second amplification unit may appropriately amplify the analog audio signals and then provide the amplified signals to the electrostatic transducer 903 in order to generate a sound according to the original audio signals. In some embodiments, the digital to analog converter 830 is also configured to provide the analog audio signals to the first electronics module 801, for example, in cases where the audio signals are received via the analog audio port and front end module 926 that are only provided in the second electronics module 901. In such cases, the analog audio signals may be provided to the low voltage amplifier 818 of the first electronics module 801 via a cable embedded within the headband of the electrostatic headphone (e.g., the cable 110).

Though the embodiments described herein show a headphone with electrostatic transducers and high voltage amplifiers integrated into each ear cup, other embodiments may include other types of audio transducers or speakers coupled to the high voltage amplifiers (such as, e.g., a planar magnetic driver, a dynamic driver, etc.). Similarly, though the embodiments described herein show an over-ear or on-ear electrostatic headphone with integrated high voltage amplifier, other embodiments may include an electrostatic earphone, or in-ear headphone, that has a high voltage amplifier and high voltage power supply integrated into the housing of each earphone or earbud, or is otherwise attached to the earphones (e.g., within a housing that sits behind the ear and/or loops over the ear).

Any process descriptions or blocks in figures should be understood as representing modules, segments, or portions of code which include one or more executable instructions for implementing specific logical functions or steps in the process, and alternate implementations are included within the scope of the embodiments of the invention in which functions may be executed out of order from that shown or discussed, including substantially concurrently or in reverse order, depending on the functionality involved, as would be understood by those having ordinary skill in the art.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed.

Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

What is claimed is:

1. An electrostatic headphone, comprising:

a first ear cup assembly;

a second ear cup assembly; and a headband assembly coupled to each of the first ear cup assembly and the second ear cup assembly, wherein each ear cup assembly comprises an electrostatic transducer, a high voltage amplifier electrically coupled to the electrostatic transducer, and a high voltage power supply electrically coupled to the high voltage amplifier, at least one of the ear cup assemblies further comprising a power source configured to provide electric power to the high voltage power supply included in the at least one ear cup assembly.

2. The electrostatic headphone of claim 1, wherein one or more of the ear cup assemblies further comprises a wireless communication module configured to wirelessly receive audio signals from an external audio source.

3. The electrostatic headphone of claim 2, wherein the one or more ear cup assemblies further comprises a digital signal processor for processing the received audio signals.

4. The electrostatic headphone of claim 2, further comprising a cable included within the headband assembly for electrically connecting the first and second ear cup assemblies, wherein the wireless communication module is included in the first ear cup assembly, and the cable is configured to transport the audio signals from the first ear cup assembly to the second ear cup assembly.

5. The electrostatic headphone of claim 2, wherein each ear cup assembly comprises a separate wireless communication module.

6. The electrostatic headphone of claim 5, wherein the wireless communication module in the first ear cup assembly is configured to receive the audio signals from the external audio source and transmit the audio signals to the wireless communication module in the second ear cup assembly.

7. The electrostatic headphone of claim 5, wherein the wireless communication module in each ear cup assembly is configured to receive the audio signals from the external audio source.

8. The electrostatic headphone of claim 1, further comprising a cable included within the headband assembly for electrically connecting the first and second ear cup assemblies, wherein the power source is included in the second ear cup assembly, and the cable is configured to transport the electric power from the power source to the first ear cup assembly.

9. The electrostatic headphone of claim 1, wherein each ear cup assembly comprises a separate power source for providing the electric power to the high voltage power supply included in the respective ear cup assembly.

10. The electrostatic headphone of claim 1, wherein at least one of the ear cup assemblies further comprises at least one audio port for receiving analog audio signals from an external audio source.

11. The electrostatic headphone of claim 1, wherein each ear cup assembly further comprises a low voltage amplifier electrically coupled to the high voltage amplifier, and a low voltage power supply electrically coupled to the low voltage amplifier, the low voltage power supply receiving electric power from the power source.

12. The electrostatic headphone of claim 1, wherein the high voltage power supply in each ear cup assembly is a switching power supply.

13. The electrostatic headphone of claim 1, wherein the power source comprises a battery.

14. An electrostatic headphone, comprising:

a first ear cup assembly;

a second ear cup assembly; and a headband assembly coupled to each of the first ear cup assembly and the second ear cup assembly, wherein each ear cup assembly comprises an electrostatic transducer, a high voltage amplifier electrically coupled to the electrostatic transducer, and a high voltage power supply electrically coupled to the high voltage amplifier, and wherein the first ear cup assembly further comprises a power source configured to provide electric power to the high voltage power supply included in the first ear cup assembly, and the second ear cup assembly further comprises a wireless communication module configured to wirelessly receive audio signals from an external audio source.

15. The electrostatic headphone of claim 14, wherein the second ear cup assembly further comprises a digital signal processor for processing the received audio signals.

16. The electrostatic headphone of claim 14, further comprising a cable included within the headband assembly for electrically connecting the first and second ear cup assemblies, the cable being configured to transport the audio signals from the second ear cup assembly to the first ear cup assembly.

17. The electrostatic headphone of claim 14, wherein the first ear cup assembly further comprises a second wireless communication module.

18. The electrostatic headphone of claim 17, wherein the second wireless communication module is configured to receive the audio signals from the wireless communication module of the second ear cup assembly.

19. The electrostatic headphone of claim 17, wherein the second wireless communication module is configured to receive the audio signals from the external audio source.

20. The electrostatic headphone of claim 14, further comprising a cable included within the headband assembly for electrically connecting the first and second ear cup assemblies, the cable being configured to transport the electric power from the first ear cup assembly to the second ear cup assembly.

21. The electrostatic headphone of claim 1, wherein the second ear cup assembly further comprises a second power source for providing the electric power to the high voltage power supply of the second ear cup assembly.

* * * * *